US005713177A

United States Patent [19]

Peterson

[11] Patent Number: 5,713,177

[45] Date of Patent: Feb. 3, 1998

[54] GLASS SPACER BAR FOR USE IN MULTIPANE WINDOW CONSTRUCTION AND METHOD OF MAKING THE SAME

[75] Inventor: Wallace H. Peterson, Burnaby, Canada

[73] Assignee: Alumet Manufacturing, Inc., Marysville, Wash.

[21] Appl. No.: 675,524

[22] Filed: Jul. 3, 1996

Related U.S. Application Data

[62] Division of Ser. No. 307,865, Sep. 16, 1994.

[51] Int. Cl.[6] ..... E06B 3/24

[52] U.S. Cl. ..... 52/741.1; 52/745.15; 52/786.13; 52/789.1; 52/793.11; 52/204.591; 52/204.593; 52/204.62

[58] Field of Search ..... 52/786.13, 789.1, 52/790.1, 793.11, 204.591, 204.593, 204.6, 204.62, 741.1, 745.15

[56] References Cited

U.S. PATENT DOCUMENTS

| | | |
|---|---|---|
| 3,885,943 | 5/1975 | Chui . |
| 3,918,231 | 11/1975 | Kessler . |
| 3,930,825 | 1/1976 | Chui . |
| 4,146,380 | 3/1979 | Caffarella et al. . |
| 4,222,213 | 9/1980 | Kessler . |
| 4,431,691 | 2/1984 | Greenlee . |
| 4,467,168 | 8/1984 | Morgan et al. . |
| 4,576,841 | 3/1986 | Lingemann . |
| 4,613,530 | 9/1986 | Hood et al. . |
| 4,819,405 | 4/1989 | Jackson . |
| 4,859,569 | 8/1989 | Hirose et al. . |
| 5,027,574 | 7/1991 | Phillip . |
| 5,031,168 | 7/1991 | Moore . |
| 5,120,584 | 6/1992 | Ohlenforst et al. . |
| 5,125,195 | 6/1992 | Brede . |
| 5,131,194 | 7/1992 | Anderson . |
| 5,132,505 | 7/1992 | Zonneveld et al. . |
| 5,191,574 | 3/1993 | Henshaw et al. . |
| 5,331,738 | 7/1994 | Lingemann . |
| 5,424,111 | 6/1995 | Farbstein . |
| 5,437,902 | 8/1995 | Itoh et al. . |
| 5,439,716 | 8/1995 | Larsen . |

FOREIGN PATENT DOCUMENTS

| | | |
|---|---|---|
| 1 916 075 | 10/1969 | Germany . |
| 2 144 167 | 2/1985 | United Kingdom . |

*Primary Examiner*—Wynn E. Wood

*Attorney, Agent, or Firm*—Christensen O'Connor Johnson & Kindness PLLC

[57] ABSTRACT

A multipane window assembly has first and second panes of glass separated by a spacer frame that is constructed of joined tubular members. The tubular members are glass tubes, each of which has a first and second side adjacent the glass panes and a third side that bridges the first and second sides and is adjacent the airspace between the glass panes of the multipane window assembly. A plurality of holes is formed in the third side of the glass tube to allow airflow between the interior of the spacer tube and the airspace defined by the glass panes. The third side of the glass tube includes a reduced-thickness portion in which the holes are formed. The holes are preferably formed by exposing the reduced-thickness portion to a focused laser beam with sufficient energy to melt the holes in the glass. Capture of energy from the laser beam is enhanced by treating the surface of the reduced-thickness portion to make it opaque to the laser beam, either by etching or by coating with paint or ink. Alternatively, the laser beam could be matched to the composition of the glass such that the laser beam is of a frequency that the glass is opaque to the particular frequency of light used. An apparatus to form the glass tube includes a laser beam source, a focusing means to focus the laser beam on the glass tube, and a conveyor means to move the glass tube through the path of the laser beam in a controlled fashion to allow the surface to be exposed to the laser beam sufficiently to melt the hole in the tube and then move on so that a succession of spaced holes are formed in the glass tube. The apparatus can also include a means for modifying the surface of the glass tube that is exposed to the laser beam, either by coating or frosting the surface.

13 Claims, 2 Drawing Sheets

GLASS SPACER BAR FOR USE IN MULTIPANE WINDOW CONSTRUCTION AND METHOD OF MAKING THE SAME

This is a divisional of prior application Ser. No. 08/307, 865, filed Sep. 16, 1994, the benefit of the filing date of which is hereby claimed under 35 U.S.C. §120.

NATURE OF THE INVENTION

This invention relates to multipane windows and, more particularly, to a glass spacer bar used in separating the panes of the multipane window. The invention also relates to a method of making the glass spacer bars.

BACKGROUND OF THE INVENTION

It is well known in the art to provide a window having more than one pane of glass, the panes being separated by an airspace. Typically, such insulating windows have their glass panes separated by a frame interposed between the panes at their edges. The interior space between the panes then serves as an insulator to reduce heat flow through the glass. In the prior art it is known to manufacture the spacer frame of individual tubes made of aluminum joined at their ends to form a continuous frame. A sealant is injected around the perimeter of the glass panes to seal the glass panes and spacer frame into a single unit.

One disadvantage to the use of aluminum in the spacer frame separating the glass window panes is that the aluminum typically has a higher heat conductivity rating than the glass that it separates. Therefore, while the central portion of the window is an effective insulator by virtue of its glass-and-air construction, the edges of the window conduct heat at a more rapid rate because of the higher conductivity factor of the aluminum. Also, in situations where there are extremes of temperature encountered by the window, the coefficient of expansion of the aluminum and the glass will be different and internal stresses will build up along the edges of the glass panes due to the unequal rates of expansion of the glass and aluminum members. It would be advantageous to have a glass panel comprised of separated glass panes in which the separation was accomplished by a medium having a similar heat conductivity rating to the glass panes and a coefficient of thermal expansion equivalent to that of the glass panes.

SUMMARY OF THE INVENTION

In order to achieve the desired result discussed above, a multipane window assembly is provided that includes first and second panes of glass separated by a spacer frame constructed of joined tubular members. The tubular members are constructed of glass tubes, each tube having a first and second side adjacent the glass panes and a third side bridging the first and second sides and facing the space between the panes. The third side has a plurality of openings formed in it to provide airflow between the inner airspace and the interior of the glass tube. The airflow allows any moisture trapped within the panes of glass to be absorbed by a desiccant placed within the spacer frame tubing. In a preferred embodiment the third side of the tube has a reduced-thickness portion in which the holes are formed.

A method of constructing the glass tubes for use in the spacer frame includes the steps of extruding the tube from a batch of molten glass and forming a plurality of holes in the side of the glass tube that is in communication with the interior space between the glass panes. In a preferred embodiment the method also includes the step of forming the glass tubes with a reduced-thickness portion running the length of the tube along the side of the tube in which the holes are formed. The holes are then formed in the reduced-thickness portion. One of several methods can be used to form the holes in the glass tubing, the preferred method being a use of a laser beam that is focused by a system of lenses onto the reduced-thickness portion of the tube. The beam is focused to a point to sufficiently concentrate the laser to melt a hole into the glass tube. In order to better concentrate the energy of the laser in order to provide enough energy to melt the hole into the glass, a surface of the reduced-thickness portion is treated to enhance its energy absorption from the laser beam. One method of treatment is to frost the surface of the reduced-thickness portion using either an acid etching or sandblasting technique or, alternatively, to coat the surface of the reduced-thickness portion with an energy-absorbent substance such as paint or ink, which makes the surface opaque to the laser beam and, therefore, absorbs energy from the laser beam rather than allowing it to pass through the reduced-thickness portion of the tube.

Another method of making the holes contemplates striking the reduced-thickness portion of the tube with an impact tool with such force that a hole is punched into the reduced-thickness portion. Preferably, the tool is formed to a point so that the energy of impact is concentrated in a point on the reduced-thickness portion so that the hole is formed cleanly without fracturing of the glass surrounding it.

BRIEF DESCRIPTION OF THE DRAWINGS

The objects and advantages of the present invention will be better understood by those of ordinary skill in the art and others after reading the ensuing specification herein, taken in conjunction with the appended drawings, wherein.

DETAILED DESCRIPTION OF THE PREFERRED EMBODIMENT

Figure 1:
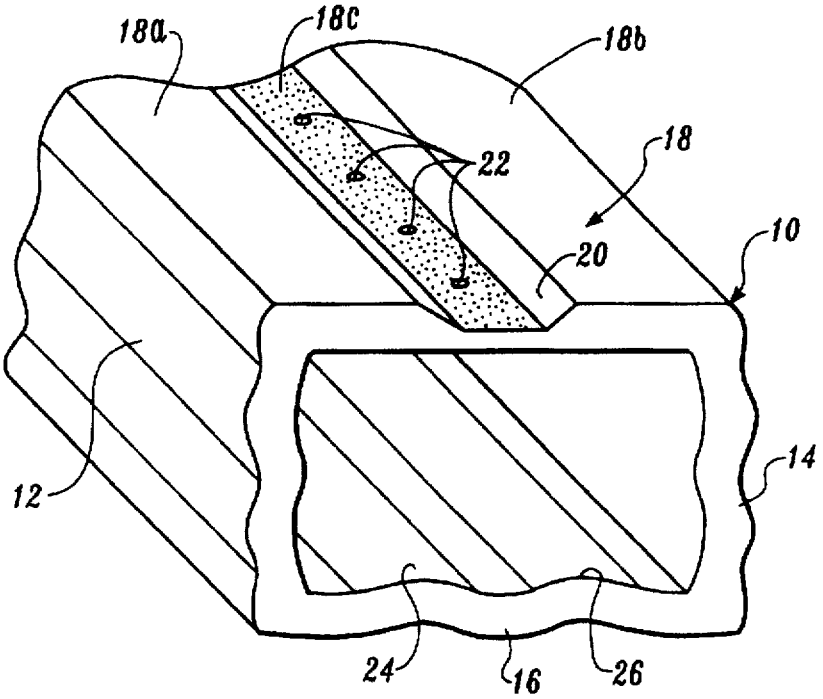
FIG. 1 is an isometric view of a portion of one embodiment of a glass spacer tube made in accordance with the principles of the present invention.

FIG. 1 illustrates one embodiment of a spacer tube made in accordance with the principles of the present invention. The spacer tube 10 has an essentially rectangular cross section and is a hollow glass tube having opposing sidewalls 12 and 14, which are adjacent the glass panes that the spacer bar is separating in the insulated window assembly. An outer wall 16 connects the sidewalls 12 and 14 and when the tube is in place in the window frame assembly the wall 16 is the wall that faces the exterior edge of the insulated glass panel. An interior wall 18, which is spaced from and opposite the exterior wall 16, is the wall that faces the interior airspace formed between the two glass panes of the insulating glass window.

The interior wall 18 has first and second portions **18*a* and 18*b* that are of a thickness approximately equal to the thickness of the sidewalls 12 and 14 and exterior walls 16. A central portion 18*c* has a reduced thickness and is, preferably, connected to the portions 18*a* and 18*b* by a sloped shoulder. The precise shape of the shoulder portions 20** is in part determined by the method used to construct the glass tube.

As is known in the art, the air trapped within the space between the two glass panes of an insulating window will have some residual moisture also trapped therein. In order to prevent this moisture from causing fogging on the inside of the glass window panes, a desiccant is typically inserted within the hollow of the spacer tube and openings are provided in the interior wall of the spacer tube to allow airflow between the interior of the tube and the interior space between the glass panes to allow the desiccant to absorb moisture from the air within the space between the glass panes. In the glass spacer tube of the present invention such pathways are provided by holes 22 formed in the reduced-thickness portion 18*c* of the interior wall 18.

While the holes 22 can be formed in several different ways, specific methods of making the holes will be discussed below as part of the invention. In order to add to the strength of the glass tube, it is possible to provide ribs 24 and 26 in the exterior wall 16. The exact shape and size and number of fibs are determined by the strength requirements for any particular glass insulating panel construction.

Figure 2:
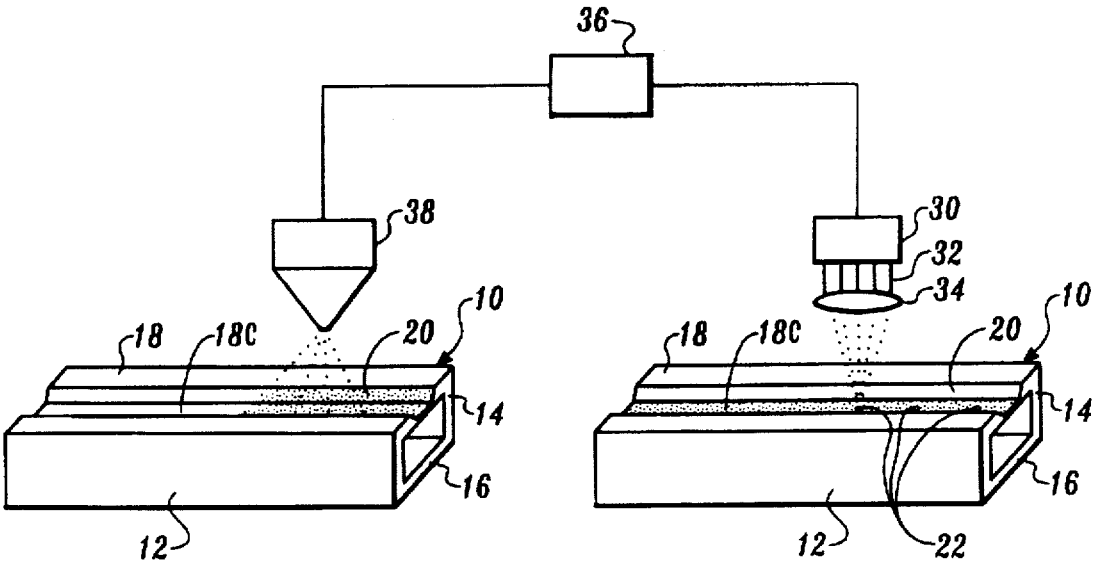
FIG. 2 is a somewhat schematic view of a system for making the glass spacer tube shown in FIG. 1.

FIG. 2 illustrates in somewhat schematic fashion a method and apparatus for making the spacer tubes of the type shown in FIG. 1 and more particularly shows a method and apparatus for producing the holes 22 in the interior wall 18. Referring now to FIG. 2, the glass tube 10, after it has left the point of extrusion and has cooled enough to provide some rigidity to the tube, passes below a laser light source 30. A laser light beam 32 emitted from the laser passes through a lens means 34, which focuses the laser beam onto the surface of interior sidewall 18. More particularly, the lens means 34 focuses the beam so that it is incident upon the surface of the reduced-thickness portion 18*c*. The reduced thickness of portion 18*c* means that there is less glass material that must be penetrated in order to make the holes 22. A controller 36 is used to control the emission of light from the laser source to coincide with the positioning of the tube 10 so that the laser emits sufficient energy to melt a hole in the wall portion 18*c*. The controller then preferably shuts down the laser until the tube 10 is moved a predetermined distance until the next location, where a hole 22 is to be formed in the wall portion 18, is positioned beneath the laser source. The laser is then reenergized to melt the hole into the wall portion 18*c*. The process is repeated until a predetermined number of holes have been formed in the length of the tube 10, at which time the tube is then moved to a storage location to await the next step in the formation of a spacer frame.

It is necessary for the laser 30 to be of sufficient power output to provide enough energy to melt a hole in the glass tube. At the same time, it is preferable to utilize as low-powered a laser as possible, primarily for cost and installation purposes but also for enhanced safety. Therefore, any steps that can be taken to enhance the energy absorption of the wall portion 18*c*, so that the power output of the laser can be minimized, will help to produce a more efficient system for forming holes in the glass tube. One such method of enhancing the energy absorption facility of the wall portion 18*c* contemplated by the invention is to render the wall portion 18*c* opaque to the laser beam so that more energy is absorbed rather than being transmitted through the glass. Again referring to FIG. 2, a spray means 38 is positioned above the path of travel of the tube 10 and upstream of the laser source 30. The tube 10, therefore, passes underneath the spray means prior to its exposure to the laser beam. The spray means can be used to spray an opaque coating onto the surface of the wall portion 18*c* to increase its opacity with regard to the laser beam. Such a spray could be comprised of a paint or an ink selected particularly for its quality of being opaque to the laser beam. At the same time, the spray should only thinly coat wall portion 18*c* so that the energy is not absorbed within the coating layer but, rather, is sufficient to supply heat to melt a hole in the wall portion 18*c*.

Alternatively, the spray means could provide an etching solution such as an acid to etch or "frost" the surface of the wall portion 18*c*, thereby also increasing its energy absorption of the laser beam. The etching could also be accomplished by a small sandblasting device positioned in the same location as the spray means 36.

As an alternative to physically altering the surface of reduced-thickness portion 18*c*, it would also be possible to analyze the makeup of the glass spacer tube and match it to a laser beam of the desired frequency that would cause the particular glass making up the spacer tube to be opaque to that frequency of light. This would allow the maximum energy absorption to occur without any physical alteration of the glass tube, thereby eliminating some of the apparatus otherwise required.

Figure 3:
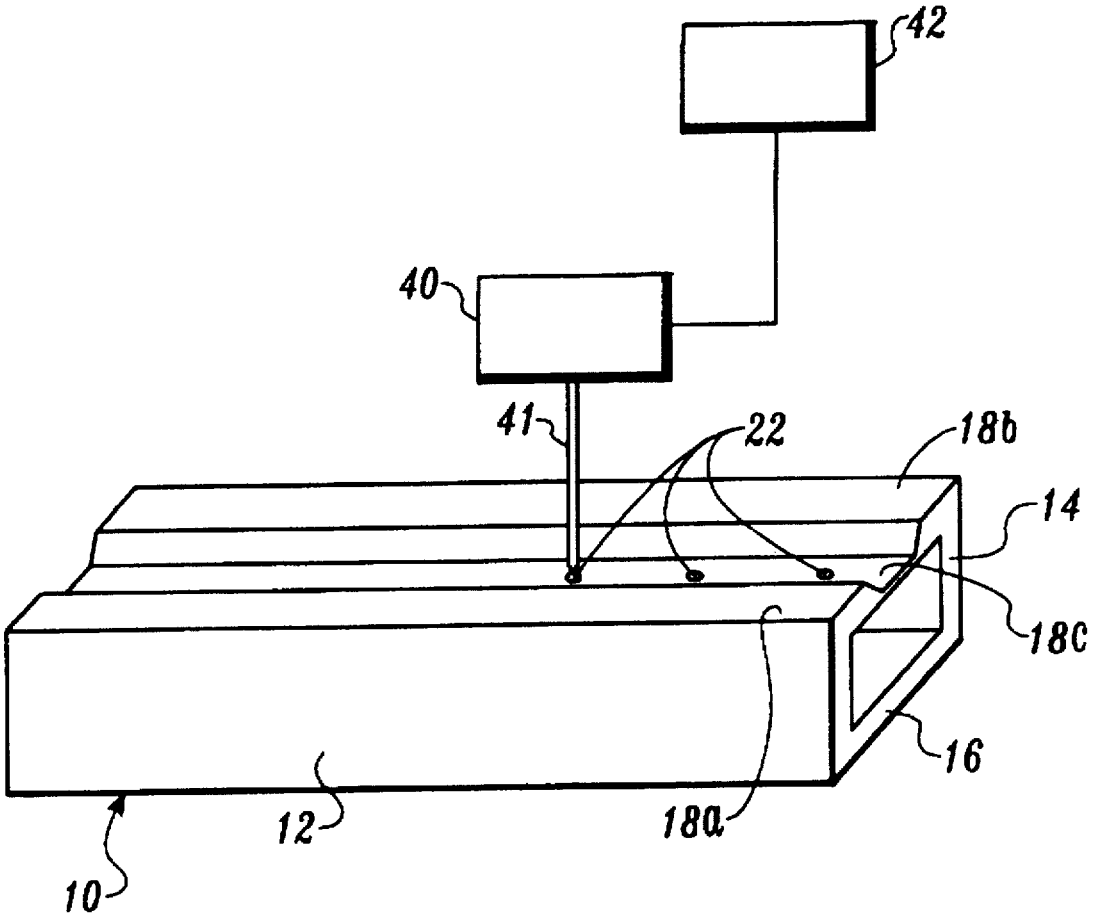
FIG. 3 is a schematic view of an alternate system for making a glass spacer tube of the type shown in FIG. 1.

FIG. 3 shows an alternate method and apparatus for producing the holes 22 in the reduced-thickness portion 18*c* of the glass tube 10. In the system of FIG. 3, the glass tube is passed beneath a hammer-drive module 40, which contains a punch 41 with a sharp point thereon. A controller 42 senses the position of the tube 10 in a conventional manner, such as with LED position sensors, and at the proper time sends a drive signal to the hammer drive, which causes the hammer drive to move the punch to impact the reduced-thickness portion 18*c* of the glass tube. The punch and the hammer drive are designed so that a short-term high-velocity impact is made on the glass tube sufficient to punch a small hole in the glass tube without inducing cracks in the area of the tube wall surrounding the hole. The tube is then moved along its length beneath the hammer drive and the hammer drive is, again, driven by the controller to impact the glass tube at the next desired location to punch another hole. When a sufficient number of holes have been punched in the glass tube the tube is then moved to a storage area to await further assembly of the spacer frame.

It can be seen by those of ordinary skill in the an that the provision of a reduced-thickness section in one wall of the glass tube is important in that it lessens the mount of material through which a hole has to be formed in order to provide air passages between the interior of the spacer tube and the interior space between the glass panes of the glass insulated window assembly. The reduced-thickness portion allows the use of different methods of providing holes in the glass spacer tube, including the melting of the hole with a laser beam or punching the hole with a highspeed impact punch. The reduced-thickness section also provides less of an opportunity for cracks to form in the area surrounding the hole after formation. It is also important that whatever means is used to provide the hole in the interior wall of the glass tube, which is adjacent the airspace, the hole not be created in the exterior wall of the glass tube, which faces the outside of the glass window assembly. By reducing the thickness of the central portion of the interior wall, energy can be directed to that portion sufficient to form a hole in the reduced-thickness portion and, yet, the energy would not be sufficient even if it accidentally was partially absorbed by the exterior wall to form a hole in the exterior wall, because of its greater wall thickness, compared to the thickness of the central portion of the interior wall. This means that one other problem in the manufacture of the glass tube is eliminated. It should be understood by those of ordinary skill in the art and others that the glass tube and manufacturing system illustrated and described are merely exemplary and that changes can be made to the illustrated embodiments of the invention while remaining within the scope of the invention. The shape of the glass tube illustrated herein is not intended to be limiting in that the tube could have a square or other shape as the particular instance required. Also, the number and size of the holes formed within the glass tube are matters of choice matched to the particular installation requirements for the glass window being formed. Since changes can be made to the illustrated embodiments, the invention should be defined solely with reference to the claims that follow.

We claim:

1. A method of forming a spacer tube for use as a spacer between first and second glass panes of a multipane window including the steps of:

extruding a tube from molten glass, the tube having first and second sides for positioning adjacent the first and second glass panels and a third side follow bridging the first and second sides positionable to face inwardly toward a space defined between the first and second sides;

cooling the glass tube to the non-molten state; and forming a plurality of holes in a longitudinal sequence in the third side of the cooled glass tube.

2. The method of claim 1, wherein said hole-forming step includes the steps of:

exposing said outside of said glass tube to the beam of a laser light source; and focusing said laser beam so that a point of light impinges on said one side of said glass tube sufficient to melt a hole in said one side.

3. The method of claim 1, further including the step of:

forming a reduced-thickness portion on one side of said tube, said holes being formed in said reduced-thickness portion.

4. The method of claim 3, wherein said hole-forming step includes the steps of:

exposing said reduced-thickness portion to the beam of a laser light source; and focusing said laser beam so that a point of light impinges on said reduced-thickness portion sufficient to melt a hole in said reduced-thickness portion.

5. The method of claim 4, further including the step of moving said tube in a linear path through said laser beam to form a series of holes spaced from one another.

6. The method of claim 4, further including the step of modifying said first surface of said reduced-thickness portion to make it opaque to said laser beam.

7. The method of claim 6, wherein said modifying step comprises spraying acid on said reduced-thickness portion to etch said first surface.

8. The method of claim 6, wherein said modifying step comprises sandblasting said reduced-thickness portion to etch said first surface.

9. The method of claim 6, wherein said modifying step comprises coating said first surface with an opaque material.

10. The method of claim 4, further including the step of selecting the frequency of said laser so that the reduced-thickness portion is opaque to said laser light.

11. The method of claim 3, wherein said hole-forming step includes impacting said reduced-thickness portion with a pointed tool to punch a hole in said reduced-thickness portion.

12. The method of claim 11, including moving said tube in a linear path beneath said tool to form a plurality of holes in said reduced-thickness portion.

13. In a method of assembling a multipane window assembly having a first and a second pane of glass separated by a spacer frame constructed of joined tubular spacer members, the improvement comprising:

constructing the spacer frame from elongate tubular glass spacer members, each glass spacer member having first and second sides for positioning adjacent the first and second glass panes and a third side for bridging the first and second sides and positionable to face inwardly toward a space defined between the first and second panes, the third side of the glass spacer member defining a longitudinal sequence of apertures.

* * * * *